United States Patent [19]

Miyachi et al.

[11] Patent Number: 5,033,399

[45] Date of Patent: Jul. 23, 1991

[54] AUTOMATIC FABRIC GUIDE IN SEWING MACHINE

[75] Inventors: Nobuji Miyachi, Kyoto; Kenji Tujimoto, Sakurai, both of Japan

[73] Assignee: Hams Corporation, Kyoto, Japan

[21] Appl. No.: 469,184

[22] Filed: Jan. 24, 1990

[30] Foreign Application Priority Data

Jan. 27, 1989 [JP] Japan ..... 1-19080

[51] Int. Cl.[5] ..... D05B 35/02; D05B 35/10

[52] U.S. Cl. ..... 112/142; 112/147; 112/153; 112/306

[58] Field of Search ..... 112/306, 308, 153, 142, 112/143, 147, 141; 271/227, 226; 226/20

[56] References Cited

U.S. PATENT DOCUMENTS

| | | | |
|---|---|---|---|
| 3,779,186 | 12/1973 | Teed | 112/306 X |
| 4,003,511 | 1/1977 | Schwestka | 226/20 X |
| 4,077,579 | 3/1978 | Seleski et al. | 226/20 X |
| 4,086,860 | 5/1978 | Kosrow et al. | 112/306 X |
| 4,089,517 | 5/1978 | Marass | 271/227 X |
| 4,292,908 | 10/1981 | Blessing | 112/306 |
| 4,541,347 | 9/1985 | Kawaguchi et al. | 112/306 X |
| 4,653,414 | 3/1987 | Harrington | 112/142 |
| 4,726,501 | 2/1988 | Wiley | 271/227 X |
| 4,730,824 | 3/1988 | Huau et al. . | |
| 4,757,773 | 7/1988 | Nomura et al. | 112/121.11 |
| 4,776,578 | 10/1988 | Hirakawa et al. | 271/227 X |
| 4,941,417 | 7/1990 | Hansberry | 112/142 |

FOREIGN PATENT DOCUMENTS

| | | |
|---|---|---|
| 0233132 | 8/1987 | European Pat. Off. . |
| 0292135 | 11/1988 | European Pat. Off. . |
| 14-7688 | 5/1939 | Japan . |
| 58-48199 | 10/1983 | Japan . |
| 1205290 | 9/1970 | United Kingdom . |

*Primary Examiner*—Werner H. Schroeder
*Assistant Examiner*—Paul C. Lewis
*Attorney, Agent, or Firm*—Wenderoth, Lind & Ponack

[57] ABSTRACT

An automatic fabric guide mechanism in a sewing machine includes at least one edge displacement detecting device including a common light source and a pair of light sensors juxtaposed to each other so as to receive rays of light from the common light source. The light source and the light sensors cooperate with each other to define a generally U-shaped channel for accommodating a free lateral edge of a fabric during the feed of the fabric past the stitching position. This detecting device is so designed and so operated as to detect the occurrence of a lateral swing of the fabric being sewed depending on whether both of the light sensors fail to receive the rays of light from the common light source or whether both of the light sensors receive the rays of the light from the common light source. The fabric guide mechanism also includes at least one control roller operable to compensate for the displacement of the fabric so that the stitching can be formed substantially exactly in alignment with an intended stitching line spaced a predetermined distance inwardly from the free lateral edge of the fabric.

3 Claims, 7 Drawing Sheets

AUTOMATIC FABRIC GUIDE IN SEWING MACHINE

BACKGROUND OF THE INVENTION

1. Field of the Invention

The present invention generally relates to an industrial sewing machine and, more particularly, to an automatic fabric guide mechanism in a sewing machine for positioning and guiding a fabric to be sewed relative to the stitching needle so that the resultant stitching can extend substantially parallel to, and is hence kept spaced a predetermined distance from, one edge of the fabric regardless of whether such edge of the fabric extends straight or curved.

2. Description of the Prior Art

The automatic fabric guide mechanism of the type referred to above is well known in the art and is utilized to avoid any possible arbitrary swing of the fabric being stitched relative to the intended stitching line set up on the fabric. In the automated garment making industry, needle-workers attendant to the sewing machines seldom lay their hands on the fabric to let the latter to be fed under the stitching needle. This is particularly true where the intended stitching line extends substantially straight or substantially parallel to one edge of the fabric where such edge of the fabric is intended to be hemmed or felled, as the fabric guide mechanism referred to above works in cooperation with the feed dog against which the fabric is pressed by means of the presser foot.

Japanese patent publication No. 39-7688, published May 16, 1964, discloses a fabric guide mechanism in a sewing machine, which mechanism comprises a photoelectric detector system in combination with a unique presser foot device. The photoelectic detector system comprises a common light source and first and second light sensors. The first light sensor is positioned laterally of and spaced a predetermined distance from the feed dog for detecting the presence or absence of one lateral edge of the fabric, and the second light sensor is positioned frontwardly of the needle hole with respect to the direction of feed of the fabric and generally in alignment with the direction of such feed for detecting the presence or absence of the fabric to be placed on the needle plate.

The presser foot device disclosed therein comprises a generally L-shaped bar having short and long bar sections contiguous to each other, a free end of said long bar section opposite to the short bar section being coupled to a machine framework for pivotal movement in a vertical plane parallel to the direction of movement of the stitching needle and also in a horizontal plane perpendicular to the vertical plane. The presser foot device also comprises a main presser foot secured to a generally intermediate portion of the long bar section and an auxiliary presser piece secured to a free end of the short bar section, said auxiliary presser piece being engaged with a motor-driven roller through the fabric.

According to the above-mentioned publication, assuming that the second sensor detects the presence of the fabric to be stitched, a reversible drive motor drivingly coupled with the roller is held a position ready to be operated. The first sensor, which presumably comprises a plurality of phototransistors or Cds sensor elements as the publication describes the first sensor having a 'center line' extending parallel to the direction of feed of the fabric, generates one of positive-going and negative-going signals when one lateral edge of the fabric being stitched deviates in a corresponding one of opposite directions laterally of the center line of the first sensor. The signal, either positive-going or negative-going, from the first sensor is utilized to drive the reversible drive motor so that the roller can be rotated in one of the opposite directions, depending on the state of the signal from the first sensor, to displace the fabric in cooperation with the auxiliary presser piece in a direction generally perpendicular to the direction of feed of the fabric thereby to keep the lateral edge of the fabric in alignment with the center line of the first sensor.

Japanese patent publication No. 58-48199, which was first laid open to public inspection on Sept. 3, 1977, under publication No. 52-105048, discloses an improvement over the fabric guide mechanism of the first mentioned Japanese publication. According to this second mentioned Japanese publication, the fabric guide mechanism is mounted on a flat bed of the sewing machine at a position laterally rightwards of the stitching needle and comprises a generally U-shaped stopper laid horizontally so as to open towards the stitching needle for restricting any possible rightward displacement of the lateral edge of the fabric, a motor-driven geared or friction wheel carried through a bevel gear system by a drive transmitting shaft rotatably housed within a tubular arm and terminating in driving connection with a drive motor at the opposite end of the tubular arm, a positioning system including a pneumatic cylinder for selectively lowering and raising the motor-driven wheel relative to a portion of the fabric adjacent the lateral edge thereof, and a detector system for detecting the displacement of the lateral edge of the fabric in a leftward direction towards the stitching needle and away from the stopper.

The system of the second mentioned publication is such that, only when the lateral edge of the fabric being stitched is displaced in such a direction that it may escape from the stopper, that is, the leftward direction, is the geared or friction wheel then lowered by the pneumatic cylinder to engage that lateral edge portion of the fabric and draw the fabric rightwards to move the intended stitching line into alignment with the stitching needle.

The prior art fabric guide mechanism according to any one of the previously mentioned Japanese publications has been found to have a problem in that, where the fabric to be stitched is very flexible and pliable, the fabric tends to be sewed in such a stretched fashion that the resultant stitching may bring about a series of gathers in cloth not called for. Accordingly, as disclosed in Japanese patent application No. 63-248490, filed in Japan on Sept. 30, 1988, (which has not yet been published as of the priority date of the instant application), the inventors of the present invention have previously devised an automatic fabric guide mechanism in the sewing machine which comprises, in addition to a detecting system for detecting any possible swing of the lateral edge of the fabric being sewed, at least one friction roller engageable with the needle plate through the fabric and drivingly coupled with a stepper motor mounted on a machine bench with a drive shaft extending parallel to the needle plate in a direction generally perpendicular to the direction of movement of the stitching needle. The friction roller is rotatable in a direction corresponding to the direction of feed of the fabric past a stitching position, the peripheral velocity of which is controlled by an output signal from the detecting system depending on the direction in which the lateral edge of the fabric swings during the feed thereof past the stitching position.

It has, however, been found that, in order for the stitching to be formed on the fabric substantially exactly in alignment with the intended stitching line spaced a predetermined distance inwardly from the lateral edge of the fabric, the fabric guide mechanism according to the above-mentioned prior invention requires the use of a complicated and expensive electric or electronic control system effective to control the peripheral velocity of the friction roller in dependence on the speed of feed of the fabric past the stitching position. In addition, the use of the stepper motor for driving the friction roller tends to render the sewing machine as a whole to be expensive to manufacture.

SUMMARY OF THE INVENTION

Accordingly, the present invention has been devised with a view to substantially eliminate the above discussed problems inherent in the prior art fabric guide mechanism in the sewing machine and has as its essential object to provide an improved automatic fabric guide mechanism for use in the sewing machine comprising: a fabric support having a needle hole defined therein for the support thereon of a fabric to be sewed, a stitching needle adapted to be reciprocally moved through the needle hole in a direction substantially perpendicular to the fabric support to accomplish a stitching operation to form a stitching on the fabric along an intended stitching line set up on a portion of the fabric spaced a predetermined distance inwardly from one lateral edge thereof, a presser means for retaining the fabric against the fabric support during the stitching operation, and a feed dog means cooperable with the presser means to feed the fabric in a predetermined direction with the progress of the stitching operation.

According to a preferred embodiment of the present invention, the improved fabric guide mechanism comprises at least one edge displacement detecting means positioned frontwardly of the stitching position with respect to the direction of feed of the fabric past the stitching position and including a common light source, which may preferably be a light emitting diode, and a pair of light sensors, which may preferably be a pair of photo-transistors, juxtaposed to each other so as to receive rays of light from the common light source, said light source and said pair of the light sensors cooperating with each other to define a generally U-shaped channel for accommodating the lateral edge of the fabric during the feed of the fabric past the stitching position. This detecting means is so designed and so operated as to detect the occurrence of a swing of the fabric being sewed depending on whether both of the light sensors fail to receive the rays of light from the common light source or whether both of the light sensors receive the rays of the light from the common light source. So long as the lateral edge of the fabric being sewed is situated intermediate the light sensors and, hence, so long as only one of the light sensors which is positioned furthest from the stitching position detects the rays of light from the light source, the stitching operation is deemed to be such that the stitching on the fabric substantially is being formed exactly in alignment with the intended stitching line spaced the predetermined distance inwardly from the lateral edge of the fabric.

The improved fabric guide mechanism also comprises at least one control roller positioned generally laterally frontwardly of the stitching position and adapted to rest on the fabric being stitched while moved over the fabric support. This control roller is carried by and is freely rotatably mounted on an axle member drivingly coupled with a drive motor, which may be either an air motor or a stepper motor, so that the axle member can rotate about an axis perpendicular to the axis of rotation of the control roller to permit the control roller to swing in a plane substantially parallel to the fabric support in one of opposite directions from a neutral position at which the direction of rotation of the control roller corresponds to the direction of feed of the fabric past the stitching position. The drive motor is of course controlled by an output signal from the detector means indicative of the displacement of the lateral edge of the fabric from a position intermediate the light sensors.

According to another preferred embodiment of the present invention, two displacement detecting means and two control rollers each associated with the respective detecting means are employed. This system can be advantageously utilized to form a seam connecting two pieces of fabric together at a position spaced a predetermined distance inwardly from the respective lateral edges thereof. In such case, the control rollers may be positioned one above the other with the associated axle members extending upwardly and downwardly with respect to the two pieces of fabric, respectively, and the two detecting means are integrated so as to form two, generally U-shaped channels one for each piece of fabric.

Alternatively, the two control rollers may be positioned in a side-by-side relationship where any one of a lap seam folder, a straight folder, a scroll hemmer, an upturn or downturn feller and a bias binder is employed.

BRIEF DESCRIPTION OF THE DRAWINGS

In any event, this and other objects and features of the present invention will become clear from the following description taken in conjunction with preferred embodiments thereof with reference to the accompanying drawings, in which:

FIGS. 3(*b*) and 3(*c*) are schematic top plan views showing how a detector system employed in the fabric guide mechanism detects a swing of a lateral edge of the fabric being stitched in one of opposite directions, respectively;

DETAILED DESCRIPTION OF THE EMBODIMENT

Figure 1:
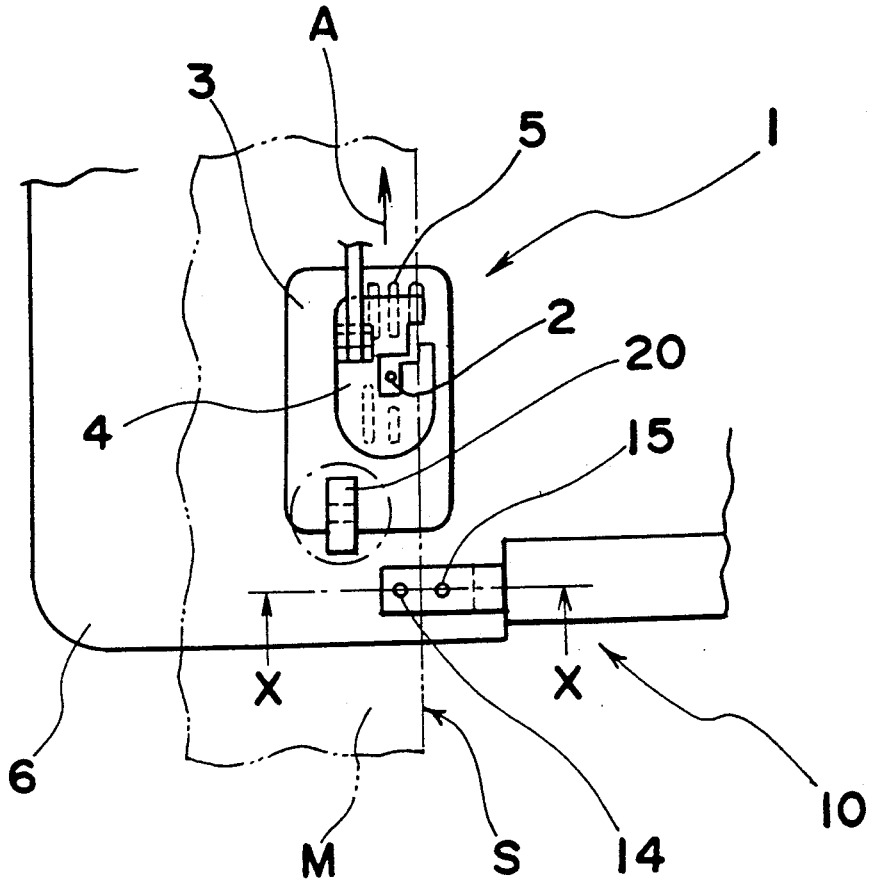
FIG. 1 is a fragmentary top plan view of an industrial sewing machine, showing an automatic fabric guide mechanism according to a first preferred embodiment of the present invention which is fitted to such sewing machine.

Before the description of the present invention proceeds, it is to be noted that like parts are designated by like reference numerals throughout the accompanying drawings.

Figure 2:
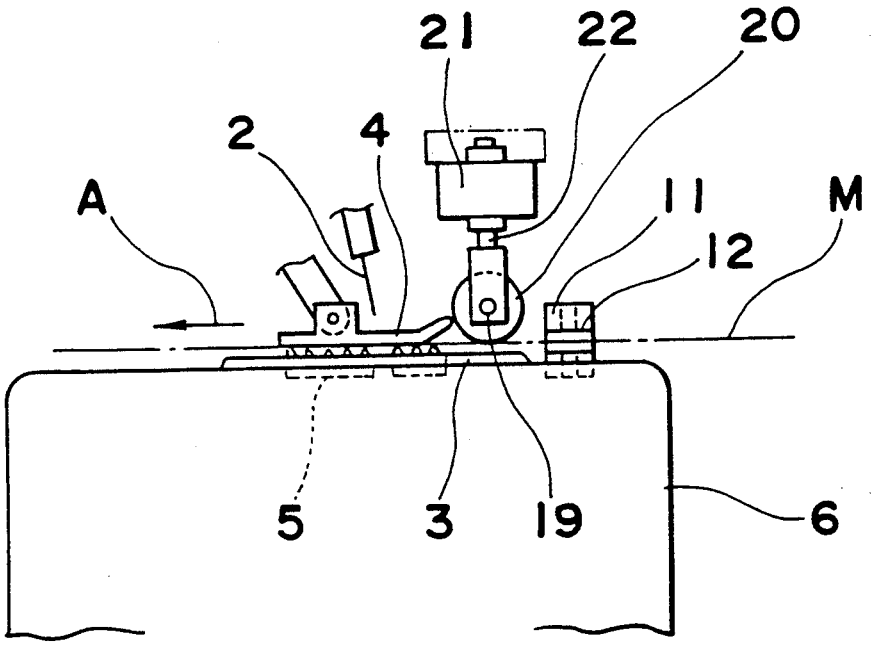
FIG. 2 is a left-hand end view of the sewing machine shown in FIG. 1.

Referring first to FIGS. 1 and 2, and industrial sewing machine of any known construction shown therein has a stitching unit 1 including a stitching needle 2 supported for reciprocating motion in a vertical direction, a needle plate 3 mounted on a machine bed 6 so as to lie beneath and perpendicular to the stitching needle 2 and having a needle hole defined therein for allowing the stitching needle 2 to pass therethrough during a stitching operation, a presser foot 4 supported by a machine head for adjustable movement between a lowered position, at which a fabric M is pressed and retained in position against the needle plate 3, and a raised position at which the fabric M can be removed from a stitching position so as to be clear from the path of movement of the stitching needle 2, and a feed dog 5 cooperable with the presser foot 4 for feeding the fabric in a predetermined rearward direction past the stitching position as indicated by the arrow A. As is well known to those skilled in the art, the stitching unit 1 is so designed and so operated that, while the presser foot 4 is in the lowered position with the fabric M sandwiched between it and the feed dog 5, and when the feed dog 5 is driven by any suitable drive mechanism in synchronism with the reciprocating motion of the stitching needle in a well-known manner, the feed dog 5 can undergo a reciprocating motion, as part of a generally elliptical trajectory, to feed the fabric M rearwards with the progress of the stitching operation thereby to form a stitching or seam on the fabric M.

Figure 3A:
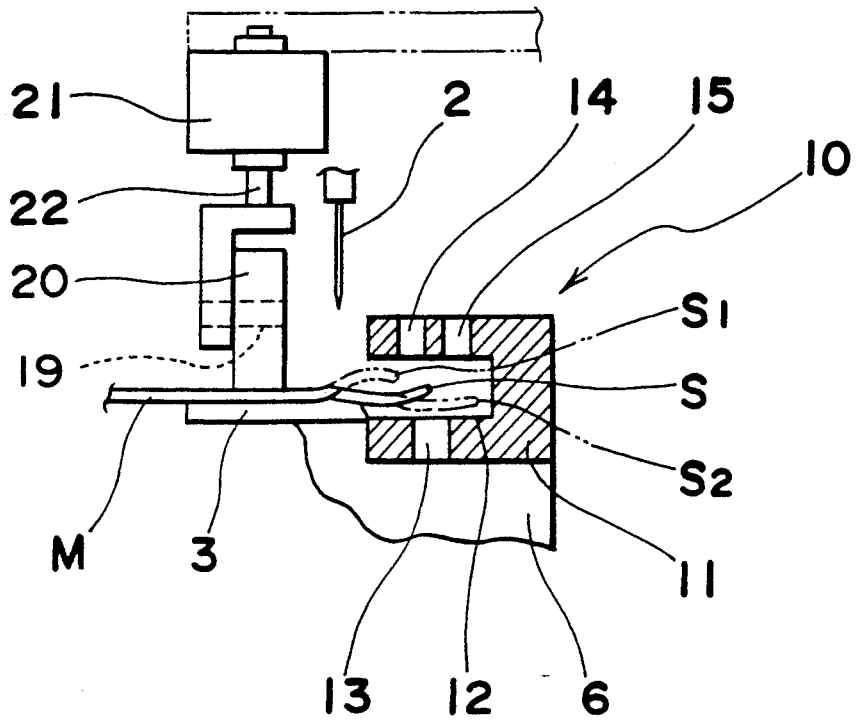
FIG. 3(*a*) is a cross-sectional view taken along the line X—X in FIG. 1.
Figure 3B:
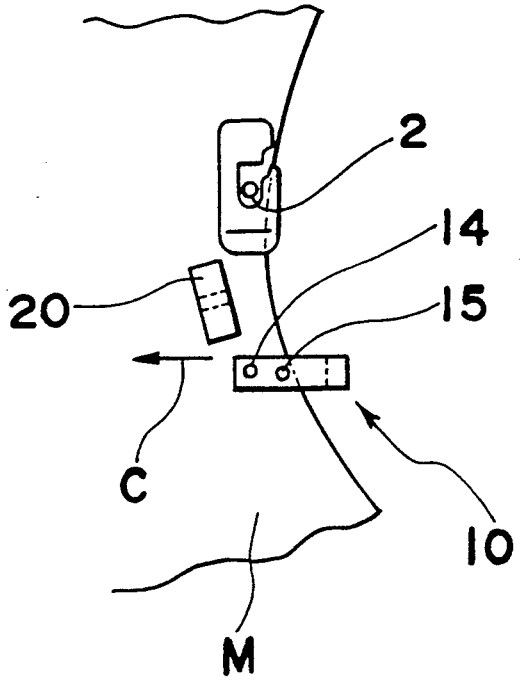
Figure 3C:
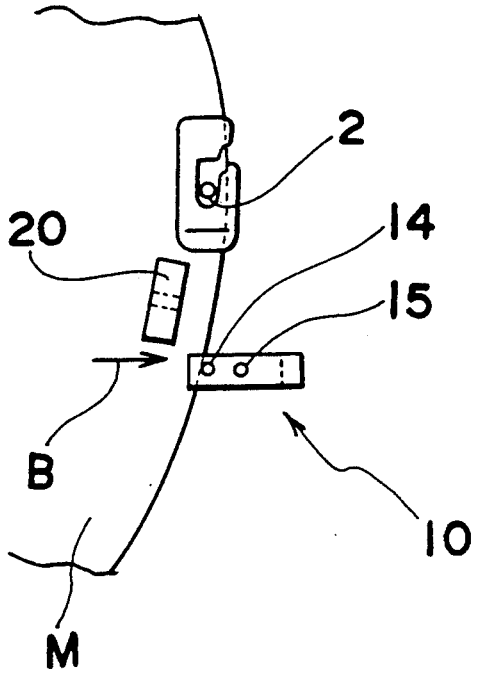

A fabric displacement detecting device identified by reference numeral 10 is positioned generally frontwardly of the stitching unit 1 with respect to the direction A of feed of the fabric M and is operable to detect any possible lateral displacement of one lateral edge or selvage S of the fabric M in one of opposite directions generally laterally of the feed direction A. As best shown in FIGS. 2 and 3, the displacement detecting device 10 comprises a generally U-shaped guide block 11 having a generally U-shaped guide channel 12 defined therein and fixedly mounted on the machine bed 6 with the opening of the guide channel 12 oriented substantially horizontally so that the lateral edge S of the fabric M being fed in the feed direction A can be accommodated within the guide channel 12. More specifically, the guide block 11 is comprised of upper and lower arms integrally connected together by means of a bridge whereby the guide block 11 has the shape of a generally horizontally laid figure "U" with the guide channel 12 delimited by the upper and lower arms and the bridge.

Figure 12:
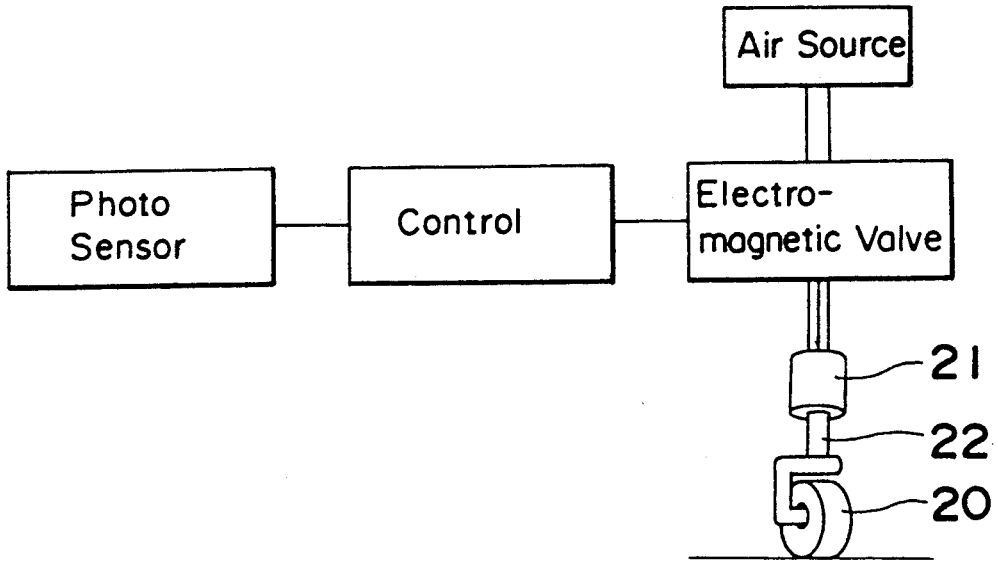
FIG. 12 is a circuit block diagram showing a control system for controlling an air motor used in the fabric guide mechanism according to any one of the preferred embodiments of the present invention.

The detecting device 10 also comprises a light emitting diode 13 mounted on the lower arm of the guide block 11 so as to emit rays of light towards the upper arm of the same guide block 11, and first and second photo-transistors 14 and 15 carried by the upper arm of the guide block 11 so as to receive the rays of light from the light emitting diode 13. As shown in FIG. 12, the sensor system including the first and second photo-transistors 14 and 15 is so designed as to provide first, second and third intelligence signals one at a time to a control circuit which is used to control an electromagnetic valve assembly as will be described later. The first intelligence signal is indicative of the situation in which the lateral edge S of the fabric M is situated intermediate the first and second photo-transistors 14 and 15 as shown in FIG. 3(*a*) and, hence, only the first photo-transistor 14 fails to receive the rays of light from the light emitting diode 13, signifying that the fabric M is being fed with the stitching eventually formed thereon in alignment with the intended stitching line; the second intelligence signal is indicative of the situation in which, as shown in FIG. 3(*b*), the lateral edge of the fabric M has displaced rightward as indicated by the phantom line S2 in FIG. 3(*a*) with both of the photo-transistors 14 and 15 consequently failing to receive the rays of light from the light emitting diode 13; and the third intelligence signal is indicative of the situation in which, as shown in FIG. 3(*c*), the lateral edge of the fabric M has displaced leftwards as indicated by the phantom line S1 in FIG. 3(*a*) with both of the photo-transistors 14 and 15 receiving the rays of light from the light emitting diode 13.

Positioned above the needle plate 3 at a location generally intermediate the stitching position and the guide block 11 is a control roller 20 having its outer peripheral surface lined with a frictional material such as polyurethane rubber effective to avoid any possible relative slip between the control roller 20 and the fabric M being fed in the feed direction A. This control roller 20 is freely rotatably mounted on a spindle 19 lying substantially parallel to the needle plate 3 and perpendicular to the stitching needle 2, which spindle 19 is carried by a drive axle 22 through a generally inverted L-shaped bracket as best shown in FIGS. 2 and 3(*a*). This control roller 20 is rotatable about the spindle 19 in contact with the fabric M being moved in the feed direction A.

The drive axis 22 forms a part of an air motor 21 and can be angularly driven in one of opposite directions from the neutral position depending on the position of the electromagnetic valve, shown in FIG. 12, which is in turn determined based on which one of the intelligence signals is supplied from the sensor system referred to above. For example, when the sensor system issues the first intelligence signal, the control circuit causes the electromagnetic valve to be held in a closed position interrupting the supply of air under pressure from an air source to the air motor 21 with the control roller 20 consequently held in the neutral position. On the other hand, when the sensor system issues the second intelligence signal, the control circuit causes the electromagnetic valve to assume a first opened position to supply air under pressure from the air source to the air motor 21 through one of two supply lines so that the drive axle 22 can be rotated in one direction to swing the control roller 20 leftwards from the neutral position as shown in FIG. 3(*b*) to cause the fabric being fed to be displaced leftwards with the intended stitching line eventually brought into alignment with the stitching position. But when the sensor system issues the third intelligence signal, the control circuit causes the electromagnetic valve to assume a second opened position to supply air under pressure from the air source to the air motor 22 through the other of the two supply lines so that the drive axle 22 can be rotated in the opposite direction to swing the control roller 20 rightwards from the neutral position as shown in FIG. 3(*c*) to cause the fabric being fed to be displaced rightwards with the intended stitching line eventually brought into alignment with the stitching position.

Figure 13:
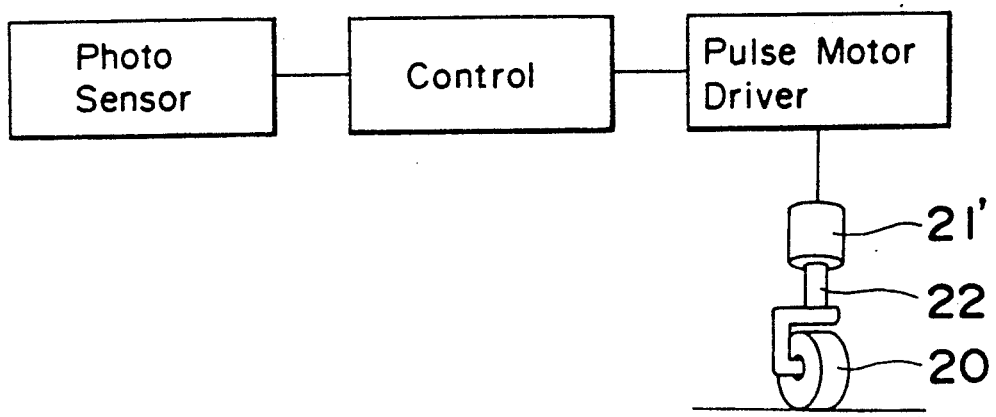
FIG. 13 is a circuit block diagram showing the control system applicable where the air motor of FIG. 12 is replaced by a stepper motor.

It is to be noted that, although in the foregoing embodiment of the present invention as well as the embodiment thereof which will be described later reference is made to the use of the air motor as the drive motor for driving the axle 22 to swing the control roller 20 in any one of the opposite directions from the neutral position, the drive motor may be employed in the form of a stepper motor or pulse motor as shown by reference numeral 21' in FIG. 13. Where the pulse motor 21' is employed, the electromagnetic valve shown in FIG. 12 has to be replaced with a pulse motor driver circuit as shown in FIG. 13.

The automatic fabric guide mechanism according to the foregoing embodiment of the present invention operates in the following manner. Assuming that the attendant worker places the fabric M on the needle plate 3 with a front portion of the lateral edge S of the fabric M inserted into the guide channel 12 in the guide block 11, the presser foot 4 and the control roller 20 have to be successively or simultaneously lowered to press the fabric against the needle plate 3. When the sewing machine is subsequently powered, the stitching operation starts. During this stitching operation, the fabric M is fed in the rearward direction A by the action of the feed dog 5 in cooperation with the presser foot 4. As the fabric M is so fed in the rearward direction A, the control roller rotates in contact with the fabric M being fed.

In the event that, with the progress of the stitching operation, a front portion of the lateral edge S of the fabric M displaces, or is caused to displace, in such a direction that that front portion of the lateral edge S intercepts the passage of the rays of light from the common light source 13 towards the photo-transistors 14 and 15 as indicated by S2 in FIG. 3(*a*) and as shown in FIG. 3(*b*), the sensor system issues the second intelligence signal with which the air motor 21 is subsequently driven to swing the control roller 20 leftwards about the axle 22 in the manner as hereinbefore described and as shown in FIG. 3(*b*). Consequent upon the leftward swing of the control roller 20, a force necessary to guide the front portion of the lateral edge S of the fabric M leftwards as indicated by the arrow C in FIG. 3(*b*) is developed and acts on the fabric M being fed. Accordingly, that front portion of the lateral edge S of the fabric M can be brought into a condition in which the intended stitching line spaced the predetermined distance inwardly from the lateral edge S of the fabric M can be brought into alignment with the stitching needle 2 to accomplish the stitching along the intended stitching line, and the control roller 20 once swung leftwards can thereafter be brought to the neutral position.

On the other hand in the event that, a front portion of the lateral edge S of the fabric M displaces, or is caused to displace, in such a direction that that front portion of the lateral edge S will not intercept the passage of the rays of light from the common light source 13 towards the photo-transistors 14 and 15 as indicated by S1 in FIG. 3(*a*) and as shown in FIG. 3(*c*), the sensor system issues the third intelligence signal with which the air motor 21 is subsequently driven, in a sense opposite to that driven in response to the generation of the second intelligence signal, to swing the control roller 20 rightwards about the axle 22 in the manner as hereinbefore described and as shown in FIG. 3(*c*). Consequent upon the rightward swing of the control roller 20, a force necessary to guide the front portion of the lateral edge S of the fabric M rightwards as indicated by the arrow B in FIG. 3(*c*) is developed and acts on the fabric M being fed. Accordingly, that front portion of the lateral edge S of the fabric M can be brought into a condition in which the intended stitching line spaced the predetermined distance inwardly from the lateral edge S of the fabric M can be brought into alignment with the stitching needle 2 to accomplish the stitching along the intended stitching line, and the control roller 20 once swung rightwards can thereafter be brought to the neutral position.

In the foregoing embodiment of the present invention, the fabric guide mechanism has been described as comprising the single control roller 20 and a single detector unit comprising the common light source 13 and the photo-transistors 14 and 15. However, where two pieces of fabric are desired to be seamed together with their lateral edges substantially exactly aligned with each other, the fabric guide mechanism according to the following embodiment of the present invention can be advantageously employed.

Figure 4:
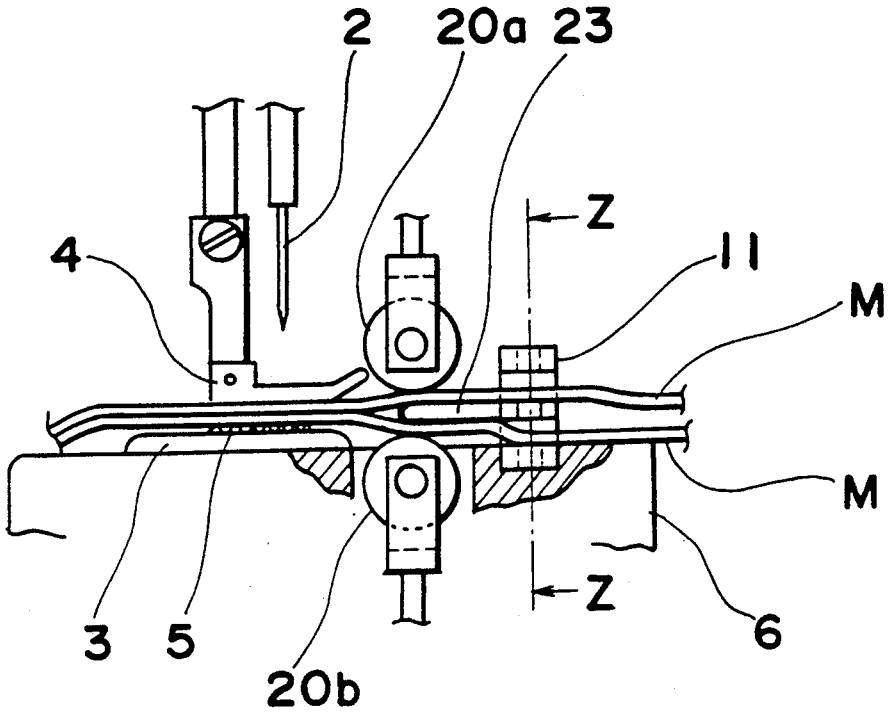
FIG. 4 is a view generally similar to FIG. 2, but on an enlarged scale, showing the fabric guide mechanism according to a second preferred embodiment of the present invention.
Figure 5:
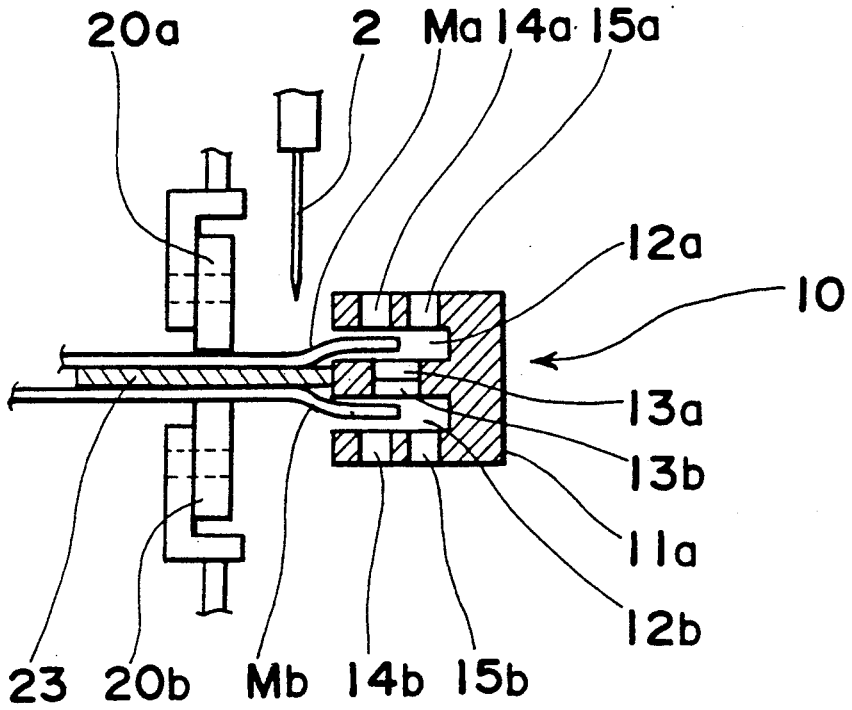
FIG. 5 is a front sectional view of the fabric guide mechanism of FIG. 4 as taken along the line Z—Z in FIG. 4.

Referring now to FIGS. 4 and 5 showing the fabric guide mechanism according to the second preferred embodiment of the present invention, two control rollers, each having a structure similar to the control roller 20, are identified by 20*a* and 20*b*. However, the control rollers 20*a* and 20*b* are supported above and beneath a back-up plate 23 lying parallel to the needle plate 3 in such a fashion that the fabric Ma and the fabric Mb positioned above and below the back-up plate 23 can be substantially urged to the opposite surfaces of the back-up plate 23 by the control rollers 20*a* and 20*b*, respectively.

The detecting device 10 used in the second preferred embodiment of the present invention comprises a generally E-shaped guide block 11*a* having generally U-shaped upper and lower guide channels 12*a* and 12*b* defined therein and fixedly mounted on the machine bed 6 with the respective openings of the guide channels 12*a* and 12*b* oriented substantially horizontally so that the lateral edges of the fabrics Ma and Mb being simultaneously fed towards the stitching position can be accommodated within the guide channels 12*a* and 12*b*, respectively. More specifically, the guide block 11*a* is comprised of upper, intermediate and lower arms integrally connected together by means of a bridge whereby the guide block 11*a* has a shape of the figure "E" with the guide channel 12*a* delimited by the upper and intermediate arms and the bridge and also with the guide channel 12*b* delimited by the intermediate and lower arms and the bridge.

The detecting device 10 shown in FIGS. 4 and 5 also comprises two detector units. Each of these detector units comprises a light emitting diode 13*a* or 13*b* mounted on the intermediate arm of the guide block 11*a* so as to emit respective rays of light towards the upper or lower arm of the same guide block 11*a* and first and second photo-transistors 14*a* and 14*b* or 15*a* and 15*b* carried by the upper or lower arms of the guide block 11 so as to receive the respective rays of light from the light emitting diode 13*a* or 13*b*. Each sensor system including the first and second photo-transistors 14*a* and 15*a* or 14*b* and 15*b* is so designed as to provide the first, second and third intelligence signals one at a time, as is the case with the foregoing embodiment of the present invention, to the control circuit which is used to operate a respective drive unit through the drive circuit in a manner similar to that in the foregoing embodiment. It is to be noted that the sensor systems operate independently from each other as they are associated with the different fabrics Ma and Mb. It is also to be noted that, although the detector units have been described and shown as having their own light sources 13*a* and 13*b*, a single light source, for example, a single light emitting diode, may be employed for these two detector units and may be so disposed as to emit rays of light towards the paired photo-transistors 14*a* and 15*a* and also towards the paired photo-transistors 14*b* and 15*b*.

The application of the present invention to the industrial sewing machine equipped with any known lap seam folder used to make a double lap seam, for example, at the hem of each trouser leg will now be described with particular reference to FIGS. 6 to 11 as a third preferred embodiment of the present invention.

Figure 6:
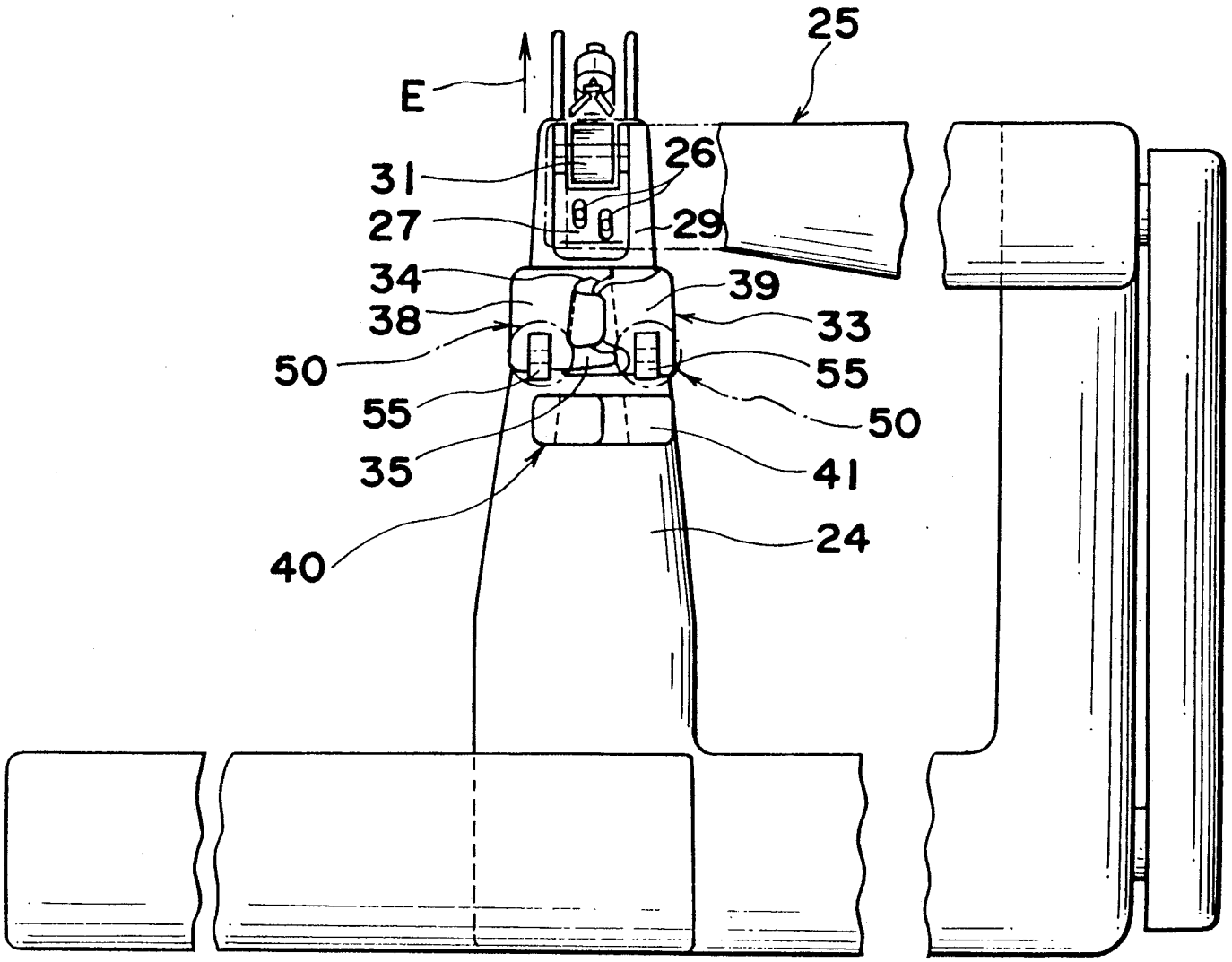
FIG. 6 is a top plan view of the sewing machine utilizing a lap seam folder, showing the use of the fabric guide mechanism according to a third preferred embodiment of the present invention.
Figure 7:
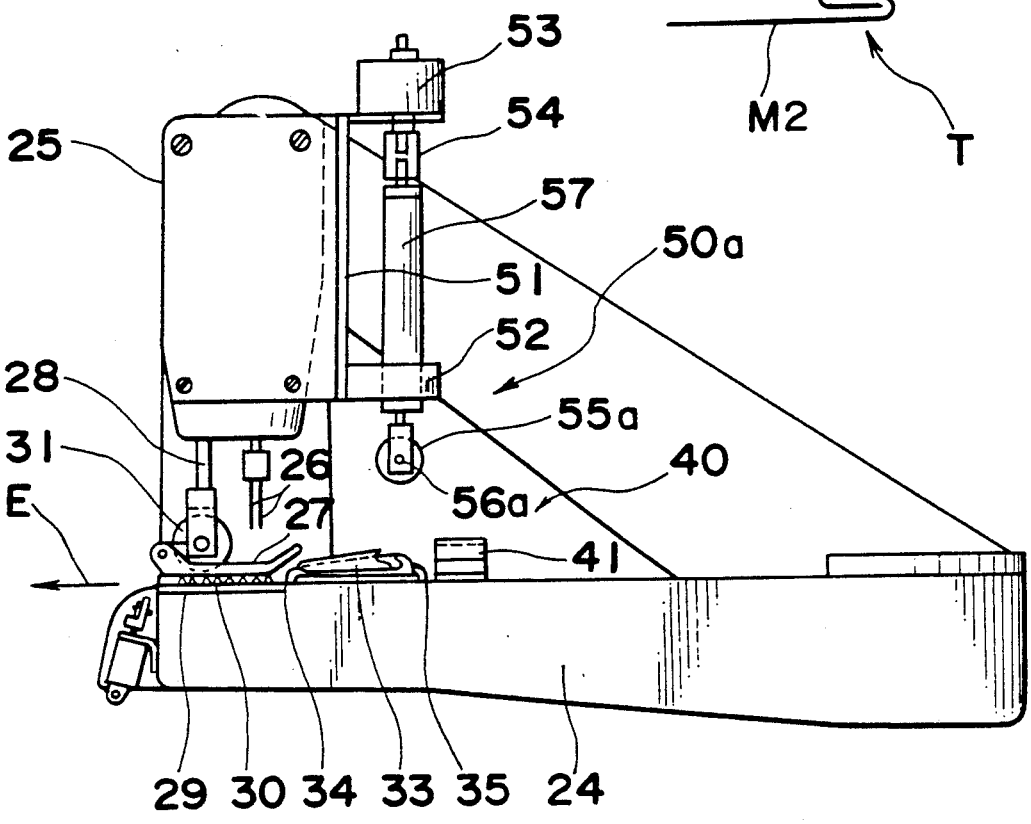
FIG. 7 is a left-hand end view of the sewing machine shown in FIG. 6.

Referring first to FIGS. 6 and 7, the industrial sewing machine identified by 25 is of a type capable of stitching two tubular fabrics one inside the other together and is well-known to those skilled in the art. This sewing machine 25 comprises two parallel stitching needles 26, a slightly rockable presser foot 27 carried by a vertically adjustably movalbe presser bar 28 which is positioned rearwardly of the stitching needles 26 for movement between lowered and raised positions and normally urged by a spring means towards the lowered position, and a feed dog 30 cooperable with the presser foot 27, in a manner similar to the feed dog 5 described in connection with the first preferred embodiment of the present invention, to feed the fabric rearwardly of the sewing machine.

The presser bar 28 has its lower end provided with a fabric feed roller 31 which is operatively coupled with an upper shaft through an eccentric mechanism (not shown) housed within the machine housing and which is, therefore, intermittently rotated in a direction shown by the arrow E to feed the fabric when the presser foot 27 has been lowered to press the fabric against the feed dog 30.

Figure 8:
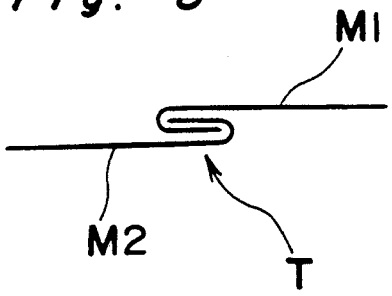
FIG. 8 is a schematic sectional view showing two pieces of fabrics connected together through a lap seam formed by the lap seam folder.

Positioned frontwardly of the stitching needles 26 is a well-known lap seam folder 33 so designed and so operable as to fold inwardly respective lateral edge portions of the fabrics M1 and M2 so that the inwardly folded lateral edge portions of the fabrics M1 and M2 can be seamed together in a generally shake-hand fashion as shown in FIG. 8 to provide a double lap seam. This lap seam folder 33 has feed and delivery ports 35 and 34 and has a length of about 40 mm as measured between the feed and delivery ports 35 and 34. The lap seam folder 33 is so positioned and so supported that the delivery port 34 can assume a position immediately frontwardly of the presser foot 27 with respect to the feed direction E.

Figure 9:
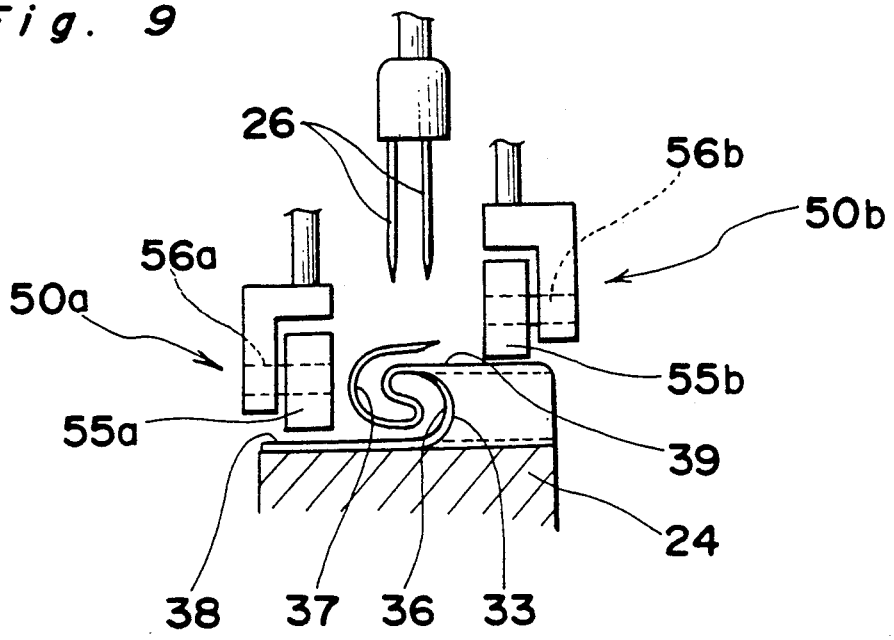
FIG. 9 is a fragmentary front elevational view, on an enlarged scale, showing the fabric guide mechanism and the scroll hemmer used in the sewing machine of FIGS. 6 and 7.

As best shown in FIG. 6 to 9, the lap seam folder 33 comprises an up-turning guide groove 36 inwardly curved in one sense for turning upwardly the lateral edge of one of the fabrics which is inserted thereinto from the left as viewed in FIG. 9 and a down-turning guide groove 37 inwardly curved in a sense opposite to the sense in which the up-turning guide groove 36 is inwardly curved, for turning downwardly the lateral edge of the other of the fabrics which is inserted thereinto from the right as viewed in FIG. 9. These up-turning and down-turning guide grooves 36 and 37 both defined in the lap seam folder 33 extend from the feed port 35 to the delivery port 34 and are so designed and so shaped that the respective lateral edge portions of the fabrics M1 and M2 can be folded inwardly and, as the respective lateral edges of the fabrics M1 and M2 emerge outwardly from the delivery port 34 for delivery towards the stitching position, the inwardly folded lateral edge portions of the fabrics M1 and M2 can then be progressively combined together in a generally shake-hand fashion, as indicated by T in FIG. 8, to eventually provide the double lap seam.

Figure 10:
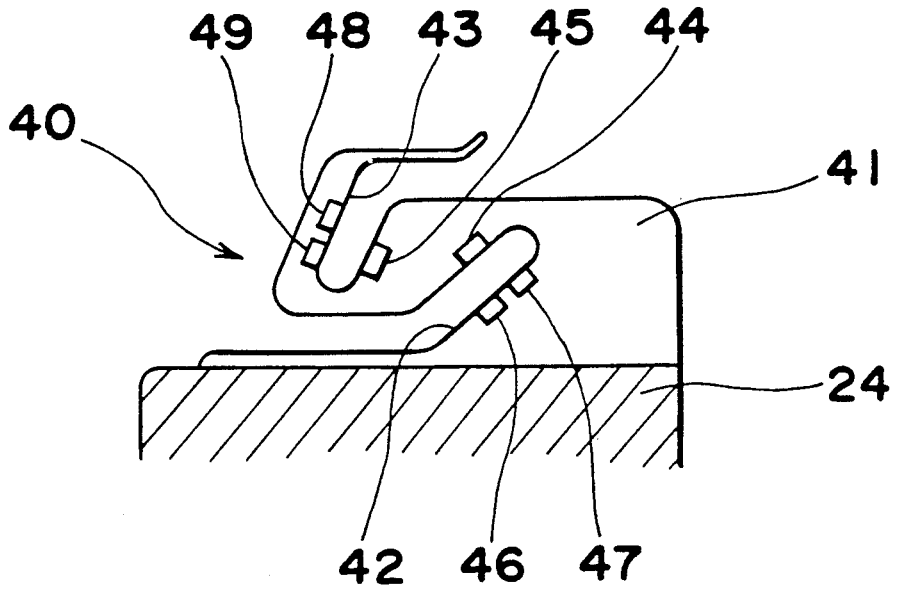
FIG. 10 is a diagram showing the fabric displacement detecting system in the fabric guide mechanism used in the sewing machine of the type employing the lap seam folder.

The detecting device is generally identified by reference numeral 40 and is positioned frontwardly of the lap seam folder 33, that is, on one of the opposite sides of the lap seam folder 33 remote from the stitching position, with respect to the feed direction E, the details of which will now be described with particular reference to FIG. 10. As best shown therein, the detecting device 40 comprises a genrally S-shaped guide block 41 rigidly mounted on a machine bench 24 and has lower and upper guide channels 42 and 43 defined therein one above the other. These lower and upper guide channels 42 and 43 have respective slot-shaped openings communicating with lower and upper guide channels 42 and 43, respectively, and opening leftwards and rightwards, respectively, for accommodating therein the respective lateral edge portions of the fabrics M2 and M1. This guide block 41 is mounted on the machine bench 24 at a specified position with the guide channels 42 and 43 aligned with the up-turning and down-turning guide grooves 36 and 37, respectively, of the lap seam folder 33 so that the lateral edge portions of the fabrics inserted into the lower and upper guide channels 42 and 43 of the guide block 41 can be smoothly and continuously fed into the up-turning and down-turning guide grooves 36 and 37 of the lap seam folder 33, respectively, as they emerge outwardly from the guide block 41 with the progress of the stitching operation, that is, during the feed of the fabrics past the stitching position.

The detecting device 40 also comprises first and second detector units each comprising a common light emitting diode 44 or 45 and a pair of photo-transistors 46 or 48 and 47 or 49. The first detector unit is so designed and so positioned that the light emitting diode 44 can emit rays of light across the lower guide channel 42 towards the photo-transistors 46 and 47 whereas the second detector unit is so designed and so positioned that the light emitting diode 45 can emit rays of light across the upper guide channel 43 towards the photo-transistors 48 and 49. Each of these first and second detector units operates in a manner similar to that described in connection with the second preferred embodiment of the present invention with reference to FIGS. 4 and 5.

The fabric guide mechanism used in the practice of the third preferred embodiment of the present invention comprises left-hand and right-hand guide roller units 50*a* and 50*b*, as viewed in FIG. 9 and with respect to the direction E of feed of the fabrics past the stitching position, which are supported above the feed port 35 of the lap seam folder 33 and on respective sides of the lap seam folder 33. These guide roller units 50*a* and 50*b* are generally identical, but are arranged in a sense substantially opposite to each other with respect to an axis parallel to any one of the stitching needles 26.

Since the guide roller units 50*a* and 50*b* are generally identical, reference will now be made only to the left-hand guide roller unit 50*a* in describing the structure of each of the guide roller units 50*a* and 50*b*. As shown in FIG. 7, the machine head, identified by reference numeral 25, has a front surface to which an upright carrier plate 51 is secured rigidly thereto, which plate 51 may be used for the support of both of the guide roller units 50*a* and 50*b*. The guide roller unit 50*a* or 50*b* comprises an air motor 53 having an axle and mounted on an upper end of the upright carrier plate 51 with the axle thereof extending downwards, a pneumatic cylinder 57 connected with the axle of the air motor 53 through a coupling 54 so as to extend downwards and supported axially nonslidably, but rotatably by a bearing arm 52 fast or integral with a lower end of the upright plate 51, said cylinder 57 having a plunger movable between retracted and projected positions relative to the cylinder 57, and a control roller 55*a* or 55*b* carried by a free end of the plunger of the cylinder 57 through a respective spindle 56*a* or 56*b* extending parallel to the needle plate 29 in a manner identical with the control roller 20 carried by the axle 22 shown in FIGS. 2 and 3(*a*).

It is to be noted that the bearing arm 52 which has been described as supporting the cylinder 57 of the left-hand guide roller unit 50*a* may also be used to support the cylinder 57 of the right-hand guide roller unit 50*b* when the upright carrier plate 51 is used to concurrently support the left-hand and right-hand guide roller units 50*a* and 50*b*.

Referring particularly to FIG. 9, when the plungers of the respective cylinders 57 are moved to the projected positions, the left-hand control roller 55*a* is brought to lightly press the fabric M2 against a flat surface area 38 contiguous to the wall defining the lower guide channel 36 in the lap seam folder 33 adjacent the feed port 35' and the right-hand control roller 55*b* is brought to lightly press the fabric M1 against a flat surface area 39 contiguous to the wall defining the upper guide channel 37 in the same lap seam folder 33 adjacent the feed port 35, respectively. It is to be noted that, as is the case with the control roller 20 employed in the first preferred embodiment of the present invention, each of the control rollers 55*a* and 55*b* can be swung together with the associated cylinder 57 from the neutral position to any one of the opposite directions in response to the application of the second or third intelligence signals for the purpose which has been described hereinbefore.

Figure 11:
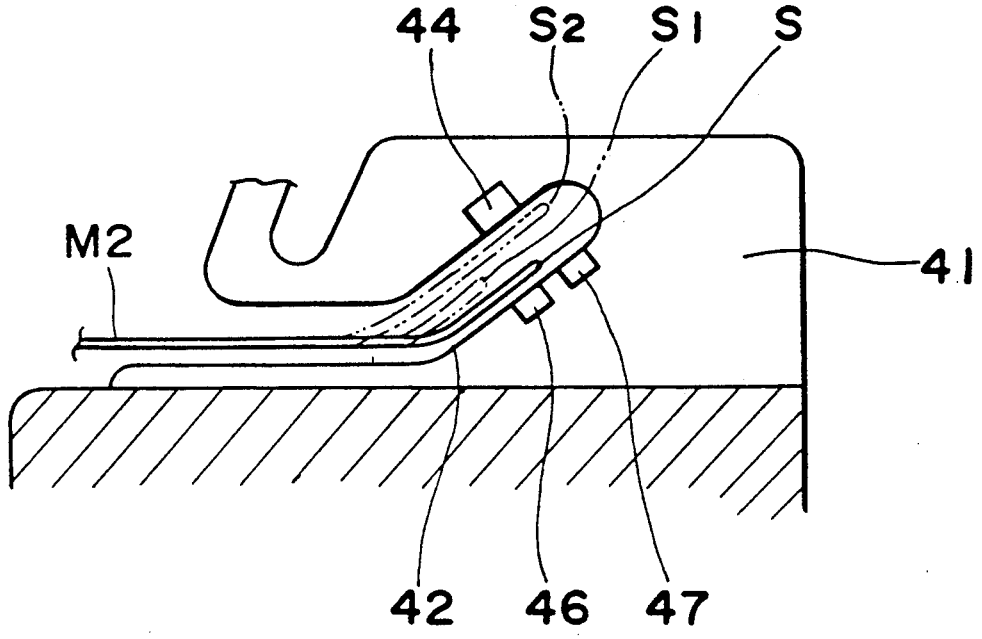
FIG. 11 is a view similar to FIG. 10, but on an enlarged scale to show how one lateral edge of the fabric is situated within a generally U-shaped detecting channel.

Specifically, referring to FIG. 11 which illustrates only the lower guide channel 42 in the guide block 41 together with the lateral edge of the fabric M2, in the event that the lateral edge S of the fabric M2 displaces, or is displaced, to the position S1 resulting in the detection of the rays of light from the light emitting diode 44 by both of the photo-transistors 46 and 47, the third intelligence signal is issued by the sensor system to eventually cause the associated control roller 55*a* to swing rightwards so that the fabric M2 can be drawn rightwards with the lateral edge thereof consequently brought to a position intermediate the photo-transistors 46 and 47 within the guide channel 42. On the other hand, in the event that the lateral edge S of the fabric M2 displaces, or is displaced, to the position S2 resulting in the failure of the photo-transistors 46 and 47 to detect the rays of light from the light emitting diode 44, the second intelligence signal is issued by the sensor system to eventually cause the associated control roller 55*a* to swing leftwards so that the fabric M2 can be drawn leftwards with the lateral edge thereof consequently brought to a position intermediate the photo-transistors 46 and 47 within the guide channel 42.

It is to be noted that, even when the lateral edge of the fabric M1 displaces or is displaced within the guide channel 43, the associated control roller 55*b* is swung from the neutral position in a manner similar to that described above.

It is also to be noted that, although both of the cylinders 57 are operated to allow the respective plungers to assume the projected position during the actual stitching operation, the plungers of the cylinders 57 can be moved to the retracted position to raise the associated control rollers 55*a* and 55*b* clear of the fabrics M2 and M1 when the sewing machine is brought to a halt.

Although the present invention has been fully described in connection with the preferred embodiments thereof with reference to the accompanying drawings, it is to be noted that various changes and modifications are apparent to those skilled in the art. By way of example, as far as the third preferred embodiment of the present invention is concerned, the two detector units of the detecting device 40 which have been shown and described as installed in the guide block 41 may be installed in the lap seam folder 33, in which case the use of the guide block 41 can be dispensed with.

Accordingly, such changes and modifications are to be understood as included within the scope of the present invention as defined by the appended claims, unless they depart therefrom.

What is claimed is:

1. In combination with a sewing machine having a fabric support for the support thereon of fabrics to be sewed, at least one stitching needle, means for reciprocally moving the at least one stitching needle at a stitching position in a direction substantially perpendicular to the fabric support to accomplish a stitching operation in which a stitching is formed on the fabrics, and a fabric feed means for feeding the fabrics in a predetermined direction of feed with the progress of the stitching operation, an automatic fabric guide mechanism for guiding the fabrics past the stitching position in a manner in which the stitching is formed along an intended stitching line respectively spaced predetermined distances inwardly from lateral edges of the fabrics, said mechanism comprising:

first and second rotatable control rollers positioned in a side-by-side fashion with respect to the direction of feed of the fabrics in the sewing machine and disposed at a location generally laterally and upstream from the stitching position with respect to the direction of feed of the fabrics;

a folding means positioned upstream of the stitching position with respect to the direction of feed of the fabrics and having first and second parallel guide channels defined therein for turning lateral edges of first and second fabrics simultaneously inwardly during passage of respective lateral edges of the first and second fabrics through the first and second guide channels such that, as the lateral edges of the first and second fabrics emerge outwardly from the folding means for delivery to the stitching position, the lateral edges of the first and second fabrics are engaged in a shake-hand fashion;

first and second drive motors each having a drive axle supporting a respective one of the control rollers thereon, each of said control rollers being angularly swingable in one of opposite directions from a neutral position, at which the control rollers rotate in to the direction of feed of the fabrics, in a plane substantially parallel to the fabric support when the drive motor is activated to rotate the axle supporting the control controller;

first and second edge displacement detecting means each for detecting any possible deviation of a free lateral edge of a respective one of the first and second fabrics in either of opposite directions from a normal position, each of said detecting means including a common light source and a pair of light sensors confronting the common light source across a generally U-shaped channel for accommodating the lateral edge of the respective one of the fabrics during the feed of the fabric past the stitching position; and each of said first and second detecting means being operatively electrically connected to a respective one of said drive motors to activate such a drive motor for selectively causing the control rollers to be swung in said either of the opposite directions from the respective neutral positions thereof depending on the direction in which the lateral edge of an associated fabric has deviated from the normal position.

2. The automatic fabric guide mechanism in a sewing machine as claimed in claim 1, wherein said first and second detecting means are installed in the folding means.

3. The automatic fabric guide mechanism in a guide machine as claimed in claim 1, wherein said light sources comprise light emitting diodes and said light sensors comprise photo-transistors.

* * * * *